US009618235B2

(12) United States Patent
Haikawa

(10) Patent No.: US 9,618,235 B2
(45) Date of Patent: Apr. 11, 2017

(54) AIR CONDITIONER INCLUDING AN INDOOR AUXILIARY HEAT EXCHANGER

(71) Applicant: DAIKIN INDUSTRIES, LTD., Osaka-shi, Osaka (JP)

(72) Inventor: Tomoyuki Haikawa, Kusatsu (JP)

(73) Assignee: DAIKIN INDUSTRIES, LTD., Osaka-shi (JP)

( * ) Notice: Subject to any disclaimer, the term of this patent is extended or adjusted under 35 U.S.C. 154(b) by 0 days.

(21) Appl. No.: 14/394,683

(22) PCT Filed: Apr. 4, 2013

(86) PCT No.: PCT/JP2013/060349
§ 371 (c)(1),
(2) Date: Oct. 15, 2014

(87) PCT Pub. No.: WO2013/157402
PCT Pub. Date: Oct. 24, 2013

(65) Prior Publication Data

US 2015/0068245 A1 Mar. 12, 2015

(30) Foreign Application Priority Data

Apr. 16, 2012 (JP) ..... 2012-093127

(51) Int. Cl.
*F25B 39/02* (2006.01)
*F25B 1/00* (2006.01)
(Continued)

(52) U.S. Cl.
CPC ..... *F25B 1/005* (2013.01); *F24F 13/0263* (2013.01); *F25B 13/00* (2013.01);
(Continued)

(58) Field of Classification Search
CPC ..... F24F 13/0263; F25B 1/005; F25B 39/02; F25B 13/00
(Continued)

(56) References Cited

FOREIGN PATENT DOCUMENTS

JP 09-014727 A 1/1997
JP 09-152193 A 6/1997
(Continued)

OTHER PUBLICATIONS

International Preliminary Report on Patentability of PCT/JP2013/060349 with English translation dated Oct. 21, 2014.
(Continued)

*Primary Examiner* — Len Tran
*Assistant Examiner* — Ana Vazquez
(74) *Attorney, Agent, or Firm* — Birch, Stewart, Kolasch & Birch, LLP

(57) ABSTRACT

Condensation occurs on an indoor fan. In an air conditioner of the present invention, an indoor heat exchanger includes an auxiliary heat exchanger 20 and a main heat exchanger 21 disposed leeward from the auxiliary heat exchanger 20. The auxiliary heat exchanger 20 is disposed forward of a front heat exchanger 21*a* of the main heat exchanger 21. In an operation in a predetermined dehumidification operation mode, a liquid refrigerant supplied to the auxiliary heat exchanger 20 all evaporates midway in the auxiliary heat exchanger 20. Then, the refrigerant having flowed through a superheat region of the auxiliary heat exchanger 20 flows through a portion of the front heat exchanger 21*a* which portion is located leeward from an evaporation region of the auxiliary heat exchanger 20.

18 Claims, 6 Drawing Sheets

(51) Int. Cl.
*F24F 13/02* (2006.01)
*F25B 13/00* (2006.01)

(52) U.S. Cl.
CPC ..... *F25B 2313/02343* (2013.01); *F25B 2313/0314* (2013.01)

(58) Field of Classification Search
USPC ..... 62/115, 276, 275, 93, 92, 272, 498, 513, 62/515, 519, 524, 525, 526; 111/115, 111/276, 275, 93, 92, 272, 498, 513, 515, 111/519, 524, 525, 526
See application file for complete search history.

(56) References Cited

FOREIGN PATENT DOCUMENTS

| | | | | |
|---|---|---|---|---|
| JP | 10-176867 | A | | 6/1998 |
| JP | 2001-082761 | A | | 3/2001 |
| JP | 2001082755 | A | * | 3/2001 |
| JP | 2001082761 | A | * | 3/2001 |
| JP | 2002-340397 | A | | 11/2002 |
| JP | 2002-364873 | A | | 12/2002 |
| JP | 2003-232553 | A | | 8/2003 |
| JP | 3454697 | B2 | * | 10/2003 |
| JP | 2008-190758 | A | | 8/2008 |

OTHER PUBLICATIONS

PCT/JP2013/060349 International Search Report Dated Jun. 18, 2013.
Extended European Search Report issued Feb. 4, 2016 in corresponding European Application No. 13778270.2.

* cited by examiner

AIR CONDITIONER INCLUDING AN INDOOR AUXILIARY HEAT EXCHANGER

TECHNICAL FIELD

The present invention relates to an air conditioner capable of performing dehumidification operation.

BACKGROUND ART

There has been a conventional air conditioner in which: an auxiliary heat exchanger is disposed rearward of a main heat exchanger; and a refrigerant evaporates only in the auxiliary heat exchanger to locally perform dehumidification so that dehumidification can be performed even under a low load (even when the number of revolution of a compressor is small), for example, when the difference between room temperature and a set temperature is sufficiently small and therefore the required cooling capacity is small. In this air conditioner, an evaporation region is limited to be within the auxiliary heat exchanger, and a temperature sensor is disposed downstream of the evaporation region, to make control so that the superheat degree is constant.

CITATION LIST

Patent Literature

Patent Literature 1: Japanese Unexamined Patent

SUMMARY OF INVENTION

Technical Problem

However, air cooled by the auxiliary heat exchanger flows to an indoor fan without reheated, and this causes a problem that condensation occurs on the indoor fan.

In view of the above, an object of the present invention is to provide an air conditioner capable of preventing condensation on the indoor fan.

Solution to Problem

According to a first aspect of the present invention, an air conditioner includes a refrigerant circuit in which a compressor, an outdoor heat exchanger, an expansion valve, and an indoor heat exchanger are connected to one another. The indoor heat exchanger includes an auxiliary heat exchanger which is disposed on a most windward side and to which a liquid refrigerant is supplied in a dehumidification operation, and a main heat exchanger disposed downstream of the auxiliary heat exchanger in the dehumidification operation; in the dehumidification operation, the auxiliary heat exchanger includes an evaporation region where the liquid refrigerant evaporates and a superheat region downstream of the evaporation region; and the refrigerant having flowed through the superheat region flows through a portion of the main heat exchanger which portion is leeward from the evaporation region.

In this air conditioner, air cooled in the evaporation region of the auxiliary heat exchanger is reheated with refrigerant gas fully heated in the superheat region, and therefore it is less likely that condensation occurs on the indoor fan.

According to a second aspect of the present invention, in the air conditioner of the first aspect of the present invention, a liquid inlet of the auxiliary heat exchanger is provided at a lower portion of the auxiliary heat exchanger.

In this air conditioner, the liquid refrigerant is supplied through the inlet at the lower portion of the auxiliary heat exchanger. Accordingly, among air passing through the auxiliary heat exchanger, cooled is a lower portion of the air. As a result, in blown out airflow, cold air is located higher while warm air is located lower. This decreases the possibility that cold air goes downward, to be less uncomfortable.

According to a third aspect of the present invention, in the air conditioner of the second aspect of the present invention, the refrigerant supplied to the liquid inlet of the auxiliary heat exchanger flows through the auxiliary heat exchanger toward an upper end of the auxiliary heat exchanger.

In this air conditioner, it is less likely that water collected by dehumidification re-evaporates on the way to flowing down to a drain pan even when cooled is only the air in the vicinity of the liquid inlet of the auxiliary heat exchanger. This increases dehumidification efficiency.

According to a fourth aspect of the present invention, in the air conditioner of any one of the first to third aspects, a refrigerant temperature detecting means for detecting a temperature of the refrigerant is provided at a position between the liquid inlet and an outlet of the auxiliary heat exchanger.

This air conditioner ensures that the superheat region is provided.

According to a fifth aspect of the present invention, in the air conditioner of any one of the first to fourth aspects, the main heat exchanger includes a front heat exchanger disposed on a front side in the indoor unit, and a rear heat exchanger disposed on a rear side in the indoor unit; and the auxiliary heat exchanger is disposed forward of the front heat exchanger.

In this air conditioner, the auxiliary heat exchanger is disposed forward of the front heat exchanger, and this allows the auxiliary heat exchanger to have a larger size, which ensures that the refrigerant is evaporated within the auxiliary heat exchanger, to reheat dehumidified cold air.

According to a sixth aspect of the present invention, in the air conditioner of the fifth aspect of the present invention, the auxiliary heat exchanger is disposed forward of the front heat exchanger, and includes a portion disposed rearward of the rear heat exchanger.

In this air conditioner, the superheat region is enlarged, and therefore air is heated with the fully heated refrigerant gas.

Advantageous Effects of Invention

As described above, the present invention provides the following advantageous effects.

In the first aspect of the present invention, air cooled in the evaporation region of the auxiliary heat exchanger is reheated with refrigerant gas fully heated in the superheat region, and therefore it is less likely that condensation occurs on the indoor fan.

In the second aspect of the present invention, the liquid refrigerant is supplied through the inlet at the lower portion of the auxiliary heat exchanger. Accordingly, among air passing through the auxiliary heat exchanger, cooled is a lower portion of the air. As a result, in blown out airflow, cold air is located higher while warm air is located lower. This decreases the possibility that cold air goes downward, to be less uncomfortable.

In the third aspect of the present invention, it is less likely that water collected by dehumidification re-evaporates on the way to flowing down to a drain pan even when cooled is only the air in the vicinity of the liquid inlet of the auxiliary heat exchanger. This increases dehumidification efficiency.

In the fourth aspect of the present invention, the air conditioner ensures that the superheat region is provided.

In the fifth aspect of the present invention, the auxiliary heat exchanger is disposed forward of the front heat exchanger, and this allows the auxiliary heat exchanger to have a larger size, which ensures that the refrigerant is evaporated within the auxiliary heat exchanger, to reheat dehumidified cold air.

In the sixth aspect of the present invention, the superheat region is enlarged, and therefore air is heated with the fully heated refrigerant gas.

DESCRIPTION OF EMBODIMENTS

The following describes an air conditioner 1 of an embodiment of the present invention.

<Overall Structure of Air Conditioner 1>

Figure 1:
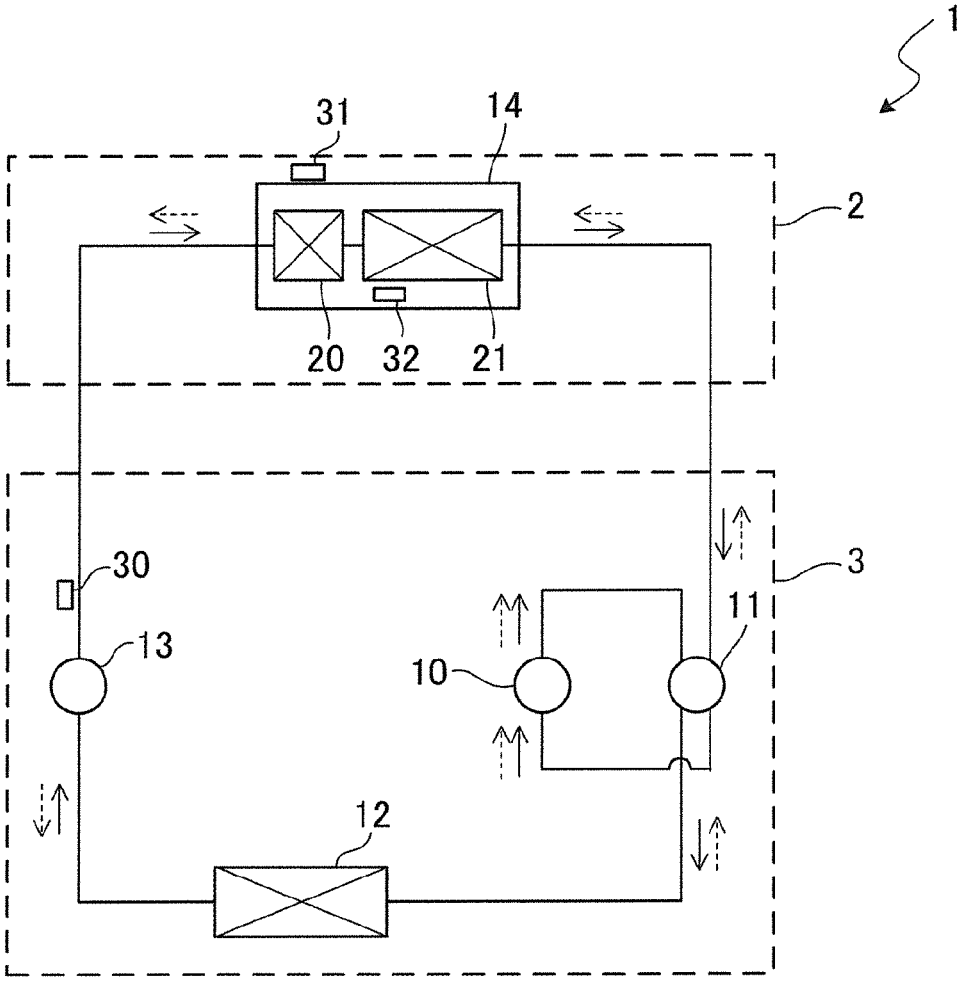
FIG. 1 is a circuit diagram showing a refrigerant circuit of an air conditioner of an embodiment of the present invention.
Figure 2:
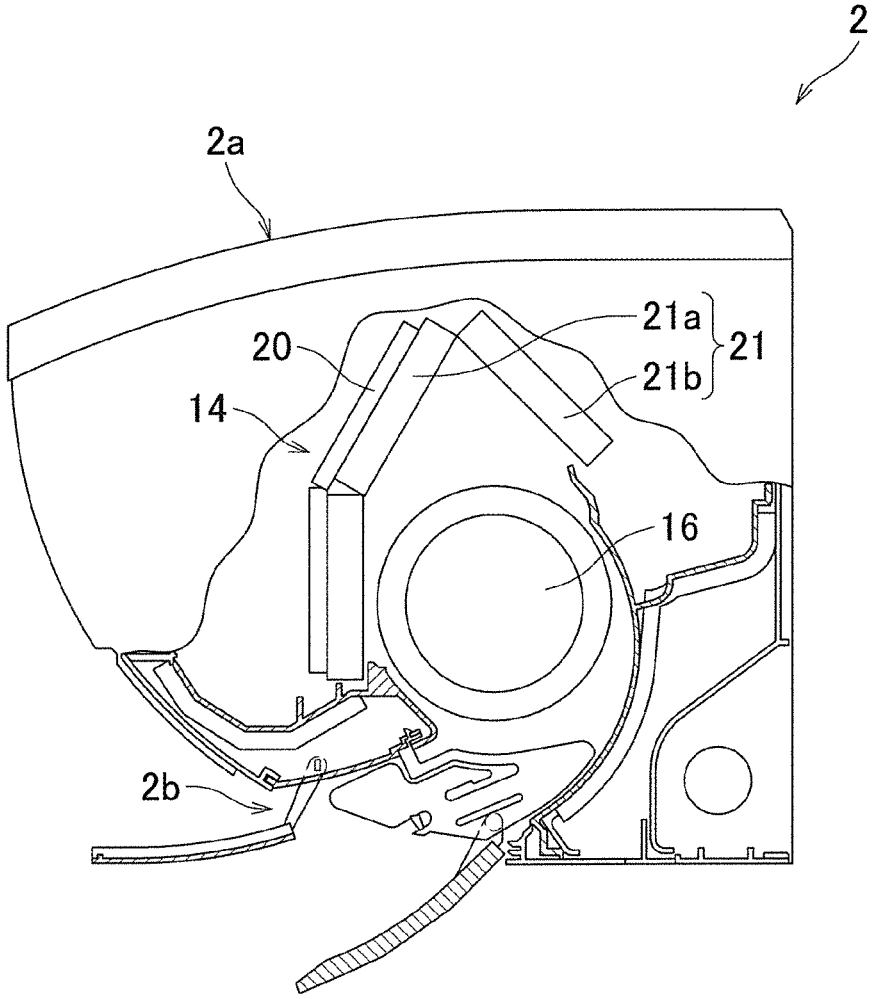
FIG. 2 is a schematic cross section of an indoor unit of the air conditioner of the embodiment of the present invention.

As shown in FIG. 1, the air conditioner 1 of this embodiment includes: an indoor unit 2 installed inside a room; and an outdoor unit 3 installed outside the room. The air conditioner 1 further includes a refrigerant circuit in which a compressor 10, a four-way valve 11, an outdoor heat exchanger 12, an expansion valve 13, and an indoor heat exchanger 14 are connected to one another. In the refrigerant circuit, the outdoor heat exchanger 12 is connected to a discharge port of the compressor 10 via the four-way valve 11, and the expansion valve 13 is connected to the outdoor heat exchanger 12. Further, one end of the indoor heat exchanger 14 is connected to the expansion valve 13, and the other end of the indoor heat exchanger 14 is connected to an intake port of the compressor 10 via the four-way valve 11. The indoor heat exchanger 14 includes an auxiliary heat exchanger 20 and a main heat exchanger 21.

In the air conditioner 1, operations in a cooling operation mode, in a predetermined dehumidification operation mode, and in a heating operation mode are possible. Using a remote controller, various operations are possible: selecting one of the operation modes to start the operation, changing the operation mode, stopping the operation, and the like. Further, using the remote controller, it is possible to adjust indoor temperature setting, and to change the air volume of the indoor unit 2 by changing the number of revolutions of an indoor fan.

As indicated with solid arrows in the figure, in the cooling operation mode and in the predetermined dehumidification operation mode, there are respectively formed a cooling cycle and a dehumidification cycle, in each of which: a refrigerant discharged from the compressor 10 flows, from the four-way valve 11, through the outdoor heat exchanger 12, the expansion valve 13, and the auxiliary heat exchanger 20, to the main heat exchanger 21 in order; and the refrigerant having passed through the main heat exchanger 21 returns back to the compressor 10 via the four-way valve 11. That is, the outdoor heat exchanger 12 functions as a condenser, and the indoor heat exchanger 14 (the auxiliary heat exchanger 20 and the main heat exchanger 21) functions as an evaporator.

Meanwhile, in the heating operation mode, the state of the four-way valve 11 is switched, to form a heating cycle in which: the refrigerant discharged from the compressor 10 flows, from the four-way valve 11, through the main heat exchanger 21, the auxiliary heat exchanger 20, and the expansion valve 13, to the outdoor heat exchanger 12 in order; and the refrigerant having passed through the outdoor heat exchanger 12 returns back to the compressor 10 via the four-way valve 11, as indicated with broken arrows in the figure. That is, the indoor heat exchanger 14 (the auxiliary heat exchanger 20 and the main heat exchanger 21) functions as the condenser, and the outdoor heat exchanger 12 functions as the evaporator.

The indoor unit 2 has, on its upper surface, an air inlet 2*a* through which indoor air is taken in. The indoor unit 2 further has, on a lower portion of its front surface, an air outlet 2*b* through which air for air conditioning comes out. Inside the indoor unit 2, an airflow path is formed from the air inlet 2*a* to the air outlet 2*b*. In the airflow path, the indoor heat exchanger 14 and a cross-flow indoor fan 16 are disposed. Therefore, as the indoor fan 16 rotates, the indoor air is taken into the indoor unit 1 through the air inlet 2*a*. In a front portion of the indoor unit 2, the air taken in through the air inlet 2*a* flows through the auxiliary heat exchanger 20 and the main heat exchanger 21 toward the indoor fan 16. Meanwhile, in a rear portion of the indoor unit 2, the air taken in through the air inlet 2*a* flows through the main heat exchanger 21 toward the indoor fan 16.

As described above, the indoor heat exchanger 14 includes: the auxiliary heat exchanger 20; and the main heat exchanger 21 located downstream of the auxiliary heat exchanger 20 in an operation in the cooling operation mode or in the predetermined dehumidification operation mode. The main heat exchanger 21 includes: a front heat exchanger 21*a* disposed on a front side of the indoor unit 2; and a rear heat exchanger 21*b* disposed on a rear side of the indoor unit 2. The heat exchangers 21*a* and 21*b* are arranged in a shape of a counter-V around the indoor fan 16. Further, the auxiliary heat exchanger 20 is disposed forward of the front heat exchanger 21*a*. Each of the auxiliary heat exchanger 20 and the main heat exchanger 21 (the front heat exchanger 21*a* and the rear heat exchanger 21*b*) includes heat exchanger pipes and a plurality of fins.

Figure 3:
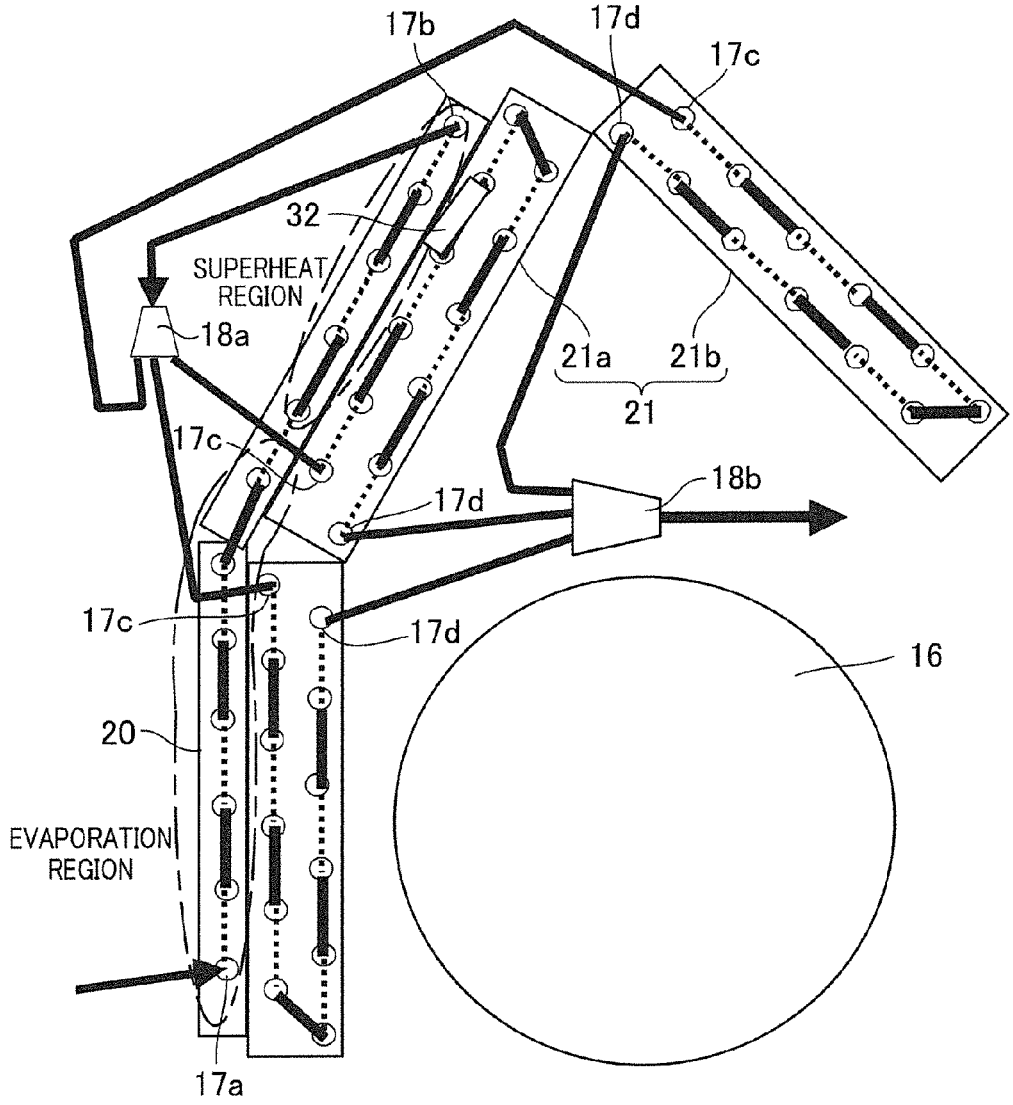
FIG. 3 is a diagram illustrating the structure of an indoor heat exchanger.

In the cooling operation mode and in the predetermined dehumidification operation mode, a liquid refrigerant is supplied through a liquid inlet 17*a* provided in the vicinity of a lower end of the auxiliary heat exchanger 20, and the thus supplied liquid refrigerant flows toward an upper end of the auxiliary heat exchanger 20, as shown in FIG. 3. Then, the refrigerant is discharged through an outlet 17*b* provided in the vicinity of the upper end of the auxiliary heat exchanger 20, and then flows to a branching section 18*a*. The refrigerant is divided at the branching section 18*a* into branches, which are respectively supplied, via three inlets 17*c* of the main heat exchanger 21, to a lower portion and an upper portion of the front heat exchanger 21*a* and to the rear heat exchanger 21*b*. Then, the branched refrigerant is discharged through outlets 17*d*, to merge together at a merging section 18*b*. In the heating operation mode, the refrigerant flows in a reverse direction of the above direction.

When the air conditioner 1 operates in the predetermined dehumidification operation mode, the liquid refrigerant supplied through the liquid inlet 17*a* of the auxiliary heat exchanger 20 all evaporates midway in the auxiliary heat exchanger 20, i.e., before reaching the outlet. Therefore, only a partial area in the vicinity of the liquid inlet 17*a* of the auxiliary heat exchanger 20 is an evaporation region where the liquid refrigerant evaporates. Accordingly, in the operation in the predetermined dehumidification operation mode, only the upstream partial area in the auxiliary heat exchanger 20 is the evaporation region, while (i) the area downstream of the evaporation region in the auxiliary heat exchanger 20 and (ii) the main heat exchanger 21 each functions as a superheat region, in the indoor heat exchanger 14.

Further, the refrigerant having flowed through the superheat region in the vicinity of the upper end of the auxiliary heat exchanger 20 flows through the lower portion of the front heat exchanger 21*a* disposed leeward from a lower portion of the auxiliary heat exchanger 20. Therefore, among the air taken in through the air inlet 2*a*, air having been cooled in the evaporation region of the auxiliary heat exchanger 20 is heated by the front heat exchanger 21*a*, and then blown out from the air outlet 2*b*. Meanwhile, among the air taken in through the air inlet 2*a*, air having flowed through the superheat region of the auxiliary heat exchanger 20 and through the front heat exchanger 21*a*, and air having flowed through the rear heat exchanger 21*b* are blown out from the air outlet 2*b* at a temperature substantially the same as an indoor temperature.

In the air conditioner 1, an evaporation temperature sensor 30 is attached to the outdoor unit 3, as shown in FIG. 1. The evaporation temperature sensor 30 is configured to detect an evaporation temperature and is disposed downstream of the expansion valve 13 in the refrigerant circuit. Further, to the indoor unit 2, there are attached: an indoor temperature sensor 31 configured to detect the indoor temperature (the temperature of the air taken in through the air inlet 2*a* of the indoor unit 2); and an indoor heat exchanger temperature sensor 32 configured to detect whether evaporation of the liquid refrigerant is completed in the auxiliary heat exchanger 20.

As shown in FIG. 3, the indoor heat exchanger temperature sensor 32 is disposed in the vicinity of the upper end of the auxiliary heat exchanger 20 and leeward from the auxiliary heat exchanger 20. Further, in the superheat region in the vicinity of the upper end of the auxiliary heat exchanger 20, the air taken in through the air inlet 2*a* is hardly cooled. Therefore, when the temperature detected by the indoor heat exchanger temperature sensor 32 is substantially the same as the indoor temperature detected by the indoor temperature sensor 31, it is indicated that evaporation is completed midway in the auxiliary heat exchanger 20, and that the area in the vicinity of the upper end of the auxiliary heat exchanger 20 is the superheat region. Furthermore, the indoor heat exchanger temperature sensor 32 is provided to a heat-transfer tube in a middle portion of the indoor heat exchanger 14. Thus, in the vicinity of the middle portion of the indoor heat exchanger 14, detected are the condensation temperature in the heating operation and the evaporation temperature in the cooling operation.

Figure 4:
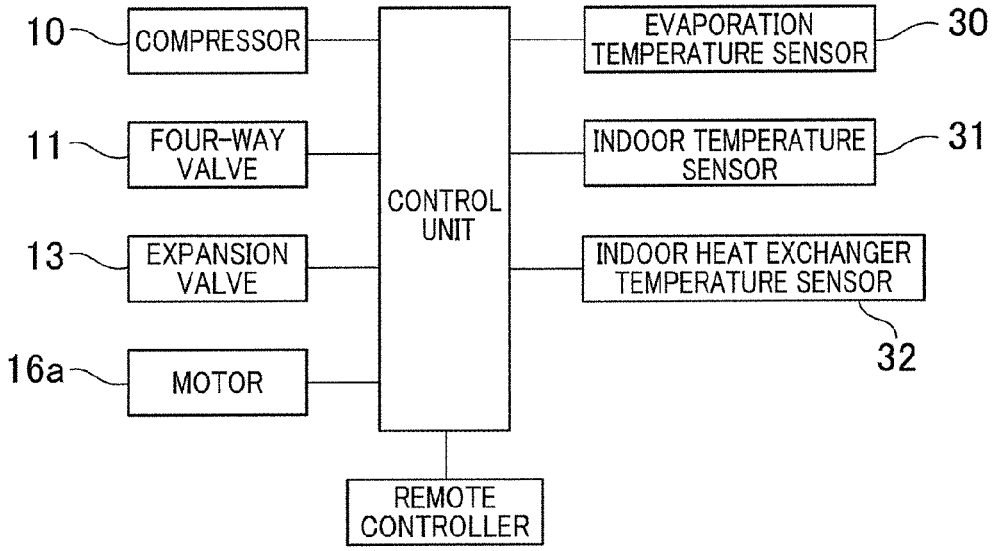
FIG. 4 is a diagram illustrating a control unit of the air conditioner of the embodiment of the present invention.

As shown in FIG. 4, the control unit of the air conditioner 1 is connected with: the compressor 10; the four-way valve 11; the expansion valve 13; a motor 16*a* for driving the indoor fan 16; the evaporation temperature sensor 30; the indoor temperature sensor 31; and the indoor heat exchanger temperature sensor 32. Therefore, the control unit controls the operation of the air conditioner 1 based on: a command from the remote controller (for the start of the operation, for indoor temperature setting, or the like); the evaporation temperature detected by the evaporation temperature sensor 30; the indoor temperature detected by the indoor temperature sensor 31 (the temperature of the intake air); and a heat exchanger middle temperature detected by the indoor heat exchanger temperature sensor 32.

Further, in the air conditioner 1, the auxiliary heat exchanger 20 includes the evaporation region where the liquid refrigerant evaporates and the superheat region downstream of the evaporation region in the predetermined dehumidification operation mode. The compressor 10 and the expansion valve 13 are controlled so that the extent of the evaporation region varies depending on a load. Here, "the extent varies depending on a load" means that the extent varies depending on the quantity of heat supplied to the evaporation region, and the quantity of heat is determined, for example, by the indoor temperature (the temperature of the intake air) and an indoor air volume. Further, the load corresponds to a required dehumidification capacity (required cooling capacity), and the load is determined taking into account, for example, the difference between the indoor temperature and the set temperature.

The compressor 10 is controlled based on the difference between the indoor temperature and the set temperature. When the difference between the indoor temperature and the set temperature is large, the load is high, and therefore the compressor 10 is controlled so that its frequency increases. When the difference between the indoor temperature and the set temperature is small, the load is low, and therefore the compressor 10 is controlled so that its frequency decreases.

The expansion valve 13 is controlled based on the evaporation temperature detected by the evaporation temperature sensor 30. While the frequency of the compressor 10 is controlled as described above, the expansion valve 13 is controlled so that the evaporation temperature falls within a predetermined temperature range (10 to 14 degrees Celsius) close to a target evaporation temperature (12 degrees Celsius). It is preferable that the predetermined evaporation temperature range is constant, irrespective of the frequency of the compressor 10. However, the predetermined range may be slightly changed with the change of the frequency as long as the predetermined range is substantially constant.

Thus, the compressor 10 and the expansion valve 13 are controlled depending on the load in the predetermined dehumidification operation mode, and thereby changing the extent of the evaporation region of the auxiliary heat exchanger 20, and causing the evaporation temperature to fall within the predetermined temperature range.

In the air conditioner 1, each of the auxiliary heat exchanger 20 and the front heat exchanger 21*a* has twelve rows of the heat-transfer tubes. When the number of rows of the tubes functioning as the evaporation region in the auxiliary heat exchanger 20 in the predetermined dehumidification operation mode is not less than a half of the total number of rows of the tubes of the front heat exchanger 21*a*, it is possible to sufficiently increase the extent of the evaporation region of the auxiliary heat exchanger, and therefore a variation in the load is addressed sufficiently. This structure is effective especially under a high load.

Figure 5:
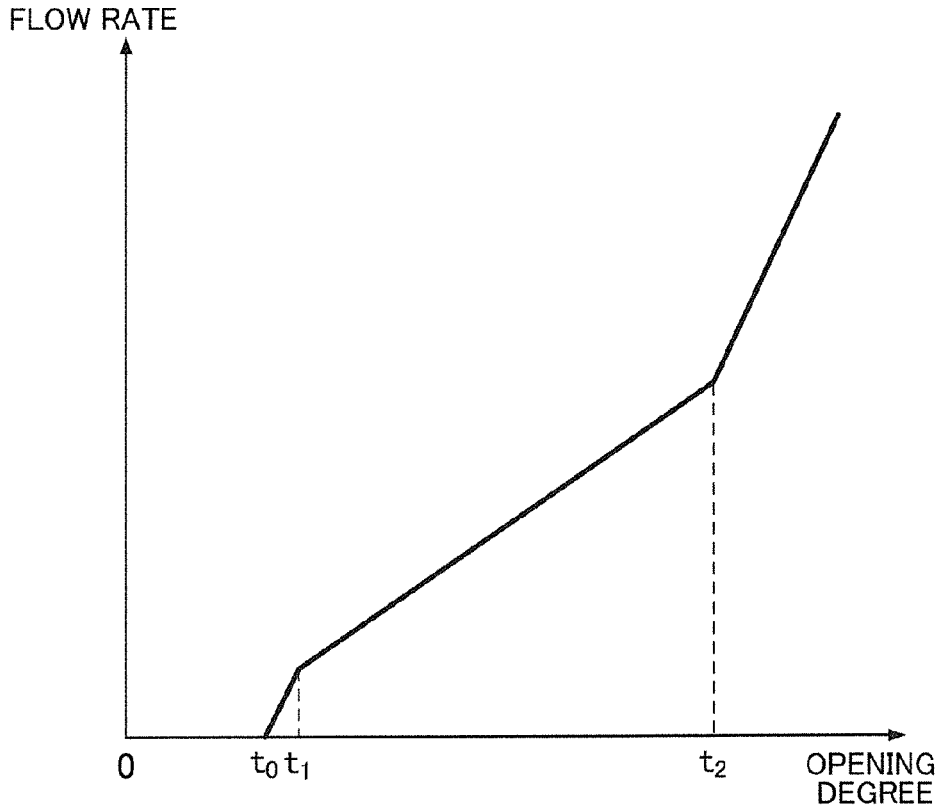
FIG. 5 is a graph showing, by way of example, how the flow rate changes as the opening degree of an expansion valve is changed.

FIG. 5 is a graph showing how the flow rate changes when the opening degree of the expansion valve 13 is changed. The opening degree of the expansion valve 13 continuously changes with the number of driving pulses input to the expansion valve 13. As the opening degree decreases, the flow rate of the refrigerant flowing through the expansion valve 13 decreases. The expansion valve 13 is fully closed when the opening degree is t0. In the range of the opening degrees t0 to t1, the flow rate increases at a first gradient as the opening degree increases. In the range of the opening degrees t1 to t2, the flow rate increases at a second gradient as the opening degree increases. Note that the first gradient is larger than the second gradient.

Now, description will be given for an example of the control made so that the extent of the evaporation region of the auxiliary heat exchanger 20 varies. For example, when the load increases in the predetermined dehumidification operation mode on the condition that the extent of the evaporation region of the auxiliary heat exchanger 20 is of a predetermined size, the frequency of the compressor 10 is increased and the opening degree of the expansion valve 13 is changed so as to increase. As a result, the extent of the evaporation region of the auxiliary heat exchanger 20 becomes larger than that of the predetermined size, and this increases the volume of the air actually passing through the evaporation region even when the volume of the air taken into the indoor unit 2 is constant.

Meanwhile, when the load becomes lower in the predetermined dehumidification operation mode on the condition that the extent of the evaporation region of the auxiliary heat exchanger 20 is of the predetermined size, the frequency of the compressor 10 is decreased and the opening degree of the expansion valve 13 is changed so as to decrease. Therefore, the extent of the evaporation region of the auxiliary heat exchanger 20 becomes smaller than that of the predetermined size, and this decreases the volume of the air actually passing through the evaporation region even when the volume of the air taken into the indoor unit 2 is constant.

<Characteristics of the Air Conditioner of this Embodiment>

In the air conditioner 1 of this embodiment, the refrigerant having flowed through the superheat region of the auxiliary heat exchanger 20 flows through a portion in the front heat exchanger 21*a* of the main heat exchanger 21 which portion is leeward from the evaporation region of the auxiliary heat exchanger 20. With this, the air cooled in the evaporation region of the auxiliary heat exchanger 20 is reheated with refrigerant gas fully heated in the superheat region, and therefore it is less likely that condensation occurs on the indoor fan 16.

Further, in the air conditioner 1 of this embodiment, the liquid inlet of the auxiliary heat exchanger 20 is provided at a lower portion of the auxiliary heat exchanger 20, and the liquid refrigerant is supplied through the inlet at the lower portion low of the auxiliary heat exchanger 20. Accordingly, among the air passing through the auxiliary heat exchanger, cooled is a lower portion of the air. As a result, in blown out airflow, cold air is located higher while warm air is located lower. This decreases the possibility that cold air goes downward, to be less uncomfortable.

Further, in the air conditioner 1 of this embodiment, the refrigerant supplied to the liquid inlet 17*a* of the auxiliary heat exchanger 20 flows through the auxiliary heat exchanger 20 toward the upper end of the auxiliary heat exchanger 20. Therefore, it is less likely that water collected by dehumidification re-evaporates on the way to flowing down to the drain pan even though cooled is only the air in the vicinity of the liquid inlet of the auxiliary heat exchanger 20. This increases dehumidification efficiency.

Furthermore, in the air conditioner 1, the main heat exchanger 21 includes: the front heat exchanger 21*a* disposed on the front side in the indoor unit 2; and the rear heat exchanger 21*b* disposed on the rear side in the indoor unit 2, and the auxiliary heat exchanger 20 is disposed forward of the front heat exchanger 21*a*. This allows the auxiliary heat exchanger 20 to have a larger size, which ensures that the refrigerant is evaporated within the auxiliary heat exchanger 20, to reheat dehumidified cold air.

The following describes air conditioners of second and third embodiments of the present invention.

Each of the air conditioners of the second and third embodiments differs from the air conditioner 1 of the first embodiment in that, the indoor heat exchanger further includes, in addition to the auxiliary heat exchanger 20 disposed forward of the front heat exchanger 21*a*, an auxiliary heat exchanger 120 disposed rearward of the rear heat exchanger 21*b*. The other features are the same as those of the air conditioner 1 of the first embodiment, and therefore the description thereof will be omitted.

Figure 6:
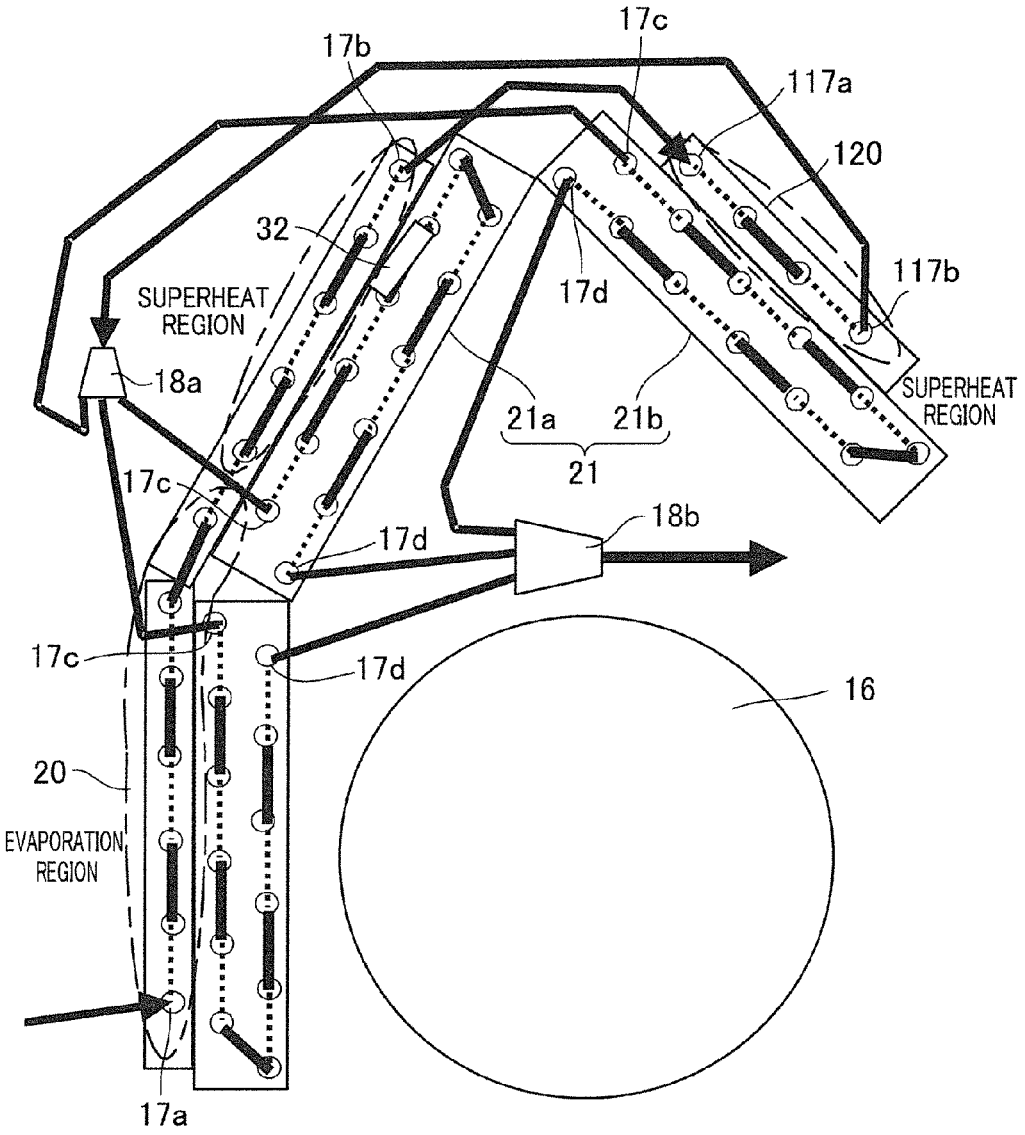
FIG. 6 is a diagram illustrating the structure of an indoor heat exchanger of an air conditioner of a second embodiment of the present invention.

In the indoor heat exchanger of the air conditioner of the second embodiment of the present invention, as shown in FIG. 6, in addition to the auxiliary heat exchanger 20 disposed forward of the front heat exchanger 21*a*, the auxiliary heat exchanger 120 is disposed rearward of the rear heat exchanger 21*b*.

In the cooling operation mode and in the predetermined dehumidification operation mode, a liquid refrigerant is supplied through the liquid inlet 17*a* provided in the vicinity of the lower end of the auxiliary heat exchanger 20, and the thus supplied liquid refrigerant flows toward the upper end of the auxiliary heat exchanger 20. Then, the refrigerant is discharged through the outlet 17*b* provided in the vicinity of the upper end of the auxiliary heat exchanger 20, and is supplied to the auxiliary heat exchanger 120 through the inlet 117*c*. The refrigerant having flowed through the auxiliary heat exchanger 120 is discharged through an outlet 117*b* and flows to the branching section 18*a*. The refrigerant is divided at the branching section 18*a* into branches, which are respectively supplied, via the three inlets 17*c* of the main heat exchanger 21, to the lower portion and the upper portion of the front heat exchanger 21*a* and to the rear heat exchanger 21*b*. Then, the refrigerant branches are discharged through the outlets 17*d*, respectively, to merge together at the merging section 18*b*. In the heating operation mode, the refrigerant flows in the reverse direction of the above direction.

When the air conditioner operates in the predetermined dehumidification operation mode, the liquid refrigerant supplied through the liquid inlet 17*a* of the auxiliary heat exchanger 20 all evaporates midway in the auxiliary heat exchanger 20, i.e., before reaching the outlet. Therefore, only a partial area in the vicinity of the liquid inlet 17*a* of the auxiliary heat exchanger 20 is the evaporation region where the liquid refrigerant evaporates. Accordingly, in the operation in the predetermined dehumidification operation mode, only the upstream partial area in the auxiliary heat exchanger 20 is the evaporation region, while (i) the area downstream of the evaporation region in the auxiliary heat exchanger 20 and (ii) the main heat exchanger 21 each functions as a superheat region, in the indoor heat exchanger.

<Characteristics of the Air Conditioner of the Second Embodiment>

In the air conditioner of the second embodiment, there are provided advantageous effects similar to those of the air conditioner of the first embodiment. Further, the superheat region is enlarged, and therefore air is heated with the fully heated refrigerant gas.

In the indoor heat exchanger of the air conditioner of the third embodiment of the present invention, in addition to the auxiliary heat exchanger 20 disposed forward of the front heat exchanger 21*a*, the auxiliary heat exchanger 120 is disposed rearward of the rear heat exchanger 21*b*.

Figure 7:
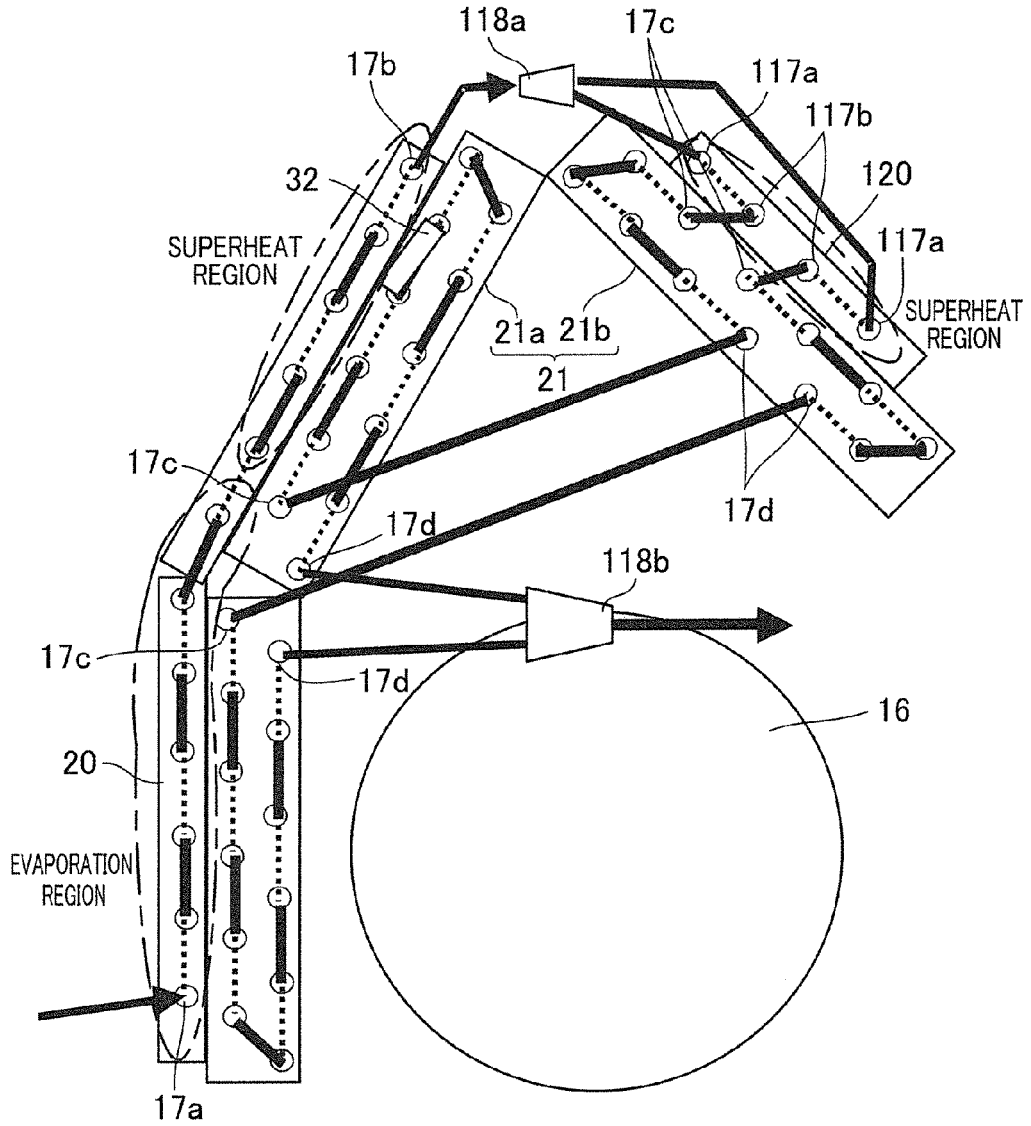
FIG. 7 is a diagram illustrating the structure of an indoor heat exchanger of an air conditioner of a third embodiment of the present invention.

In the cooling operation mode and in the predetermined dehumidification operation mode, as shown in FIG. 7, a liquid refrigerant is supplied through the liquid inlet 17*a* provided in the vicinity of the lower end of the auxiliary heat exchanger 20, and the thus supplied liquid refrigerant flows toward the upper end of the auxiliary heat exchanger 20. Then, the refrigerant is discharged through the outlet 17*b* provided in the vicinity of the upper end of the auxiliary heat exchanger 20, and is supplied to the branching section 118*a*. The refrigerant is divided at the branching section 118*a* into branches, which are supplied the auxiliary heat exchanger 120 through inlets 117*a* of the auxiliary heat exchanger 120, respectively. Then, the refrigerant branches having flowed through the auxiliary heat exchanger 120 are discharged through outlets 117*b*, and then supplied to the rear heat exchanger 21*b* through two inlets 17*c*, respectively. The refrigerant branches having flowed through the rear heat exchanger 21*b* are discharged through outlets 17*d*, and then supplied to the lower portion and the upper portion of the front heat exchanger 21*a*, respectively. Thereafter, the refrigerant branches are discharged through outlets 17*d*, respectively, to merge together at a merging section 118*b*. In the heating operation mode, the refrigerant flows in the reverse direction of the above direction.

When the air conditioner operates in the predetermined dehumidification operation mode, the liquid refrigerant supplied through the liquid inlet 17*a* of the auxiliary heat exchanger 20 all evaporates midway in the auxiliary heat exchanger 20. Therefore, only a partial area in the vicinity of the liquid inlet 17*a* of the auxiliary heat exchanger 20 is the evaporation region where the liquid refrigerant evaporates. Accordingly, in the operation in the predetermined dehumidification operation mode, only the upstream partial area in the auxiliary heat exchanger 20 is the evaporation region, while (i) the area downstream of the evaporation region in the auxiliary heat exchanger 20 and (ii) the main heat exchanger 21 each functions as a superheat region, in the indoor heat exchanger.

<Characteristics of the Air Conditioner of the Third Embodiment>

In the air conditioner of the third embodiment, there are provided advantageous effects similar to those of the air conditioner of the first embodiment. Further, the superheat region is enlarged, and therefore air is heated with the fully heated refrigerant gas.

While the embodiment of the present invention has been described based on the figures, the scope of the invention is not limited to the above-described embodiment. The scope of the present invention is defined by the appended claims rather than the foregoing description of the embodiment, and various changes and modifications can be made herein without departing from the scope of the invention.

In each of the above-described embodiments, a refrigerant temperature detecting means for detecting the temperature of the refrigerant may be provided at a position between the liquid inlet 17*a* and the outlet 17*b* in the auxiliary heat exchanger 20, and/or at a position between the at least one inlet 117*a* and the corresponding outlet 117*b* in the auxiliary heat exchanger 120.

In each of the above-described embodiments, the auxiliary heat exchanger and the main heat exchanger may be formed into a single unit. In this case, the indoor heat exchanger is formed as a single unit, and a first portion corresponding to the auxiliary heat exchanger is provided on the most windward side of the indoor heat exchanger, while a second portion corresponding to the main heat exchanger is provided leeward from the first portion.

Further, the above-described embodiment deals with the air conditioner configured to operate in the cooling operation mode, in the predetermined dehumidification operation mode, and in the heating operation mode. However, the present invention may be applied to an air conditioner configured to conduct a dehumidification operation in a dehumidification operation mode other than the predetermined dehumidification operation mode, in addition to the dehumidification operation in the predetermined dehumidification operation mode.

INDUSTRIAL APPLICABILITY

With the use of the present invention, condensation on an indoor fan is prevented.

REFERENCE SIGNS LIST

1 air conditioner
2 indoor unit
3 outdoor unit
10 compressor
12 outdoor heat exchanger
13 expansion valve
14 indoor heat exchanger
16 indoor fan
20 auxiliary heat exchanger
21 main heat exchanger

The invention claimed is:

1. An air conditioner comprising a refrigerant circuit in which a compressor, an outdoor heat exchanger, an expansion valve, and an indoor heat exchanger are connected to one another, wherein:

the indoor heat exchanger includes an auxiliary heat exchanger which is disposed on a most windward side and to which a liquid refrigerant is supplied in a dehumidification operation, and a main heat exchanger disposed downstream of the auxiliary heat exchanger in the dehumidification operation;

in the dehumidification operation, the auxiliary heat exchanger is arranged to cause the liquid refrigerant to flow upward through the auxiliary heat exchanger and includes an evaporation region where the liquid refrigerant evaporates and a superheat region downstream of the evaporation region; and the refrigerant having flowed through the superheat region is divided into branches which are respectively supplied via separate inlets of the main heat exchanger, the refrigerant in at least one of the branches then flows downward through a portion of the main heat exchanger which portion is on the most windward side and is leeward from the evaporation region.

2. The air conditioner according to claim 1, wherein a liquid inlet of the auxiliary heat exchanger is provided at a lower portion of the auxiliary heat exchanger.

3. The air conditioner according to claim 2, wherein the refrigerant supplied to the liquid inlet of the auxiliary heat exchanger flows through the auxiliary heat exchanger toward an upper end of the auxiliary heat exchanger.

4. The air conditioner according to claim 3, wherein a refrigerant temperature detecting unit configured to detect a temperature of the refrigerant is provided at a position between the liquid inlet and an outlet of the auxiliary heat exchanger.

5. The air conditioner according to claim 4, wherein:

the main heat exchanger includes a front heat exchanger disposed on a front side in an indoor unit, and a rear heat exchanger disposed on a rear side in the indoor unit; and the auxiliary heat exchanger is disposed forward of the front heat exchanger.

6. The air conditioner according to claim 5, wherein the auxiliary heat exchanger is disposed forward of the front heat exchanger, and includes a portion disposed rearward of the rear heat exchanger.

7. The air conditioner according to claim 3, wherein:

the main heat exchanger includes a front heat exchanger disposed on a front side in an indoor unit, and a rear heat exchanger disposed on a rear side in the indoor unit; and the auxiliary heat exchanger is disposed forward of the front heat exchanger.

8. The air conditioner according to claim 7, wherein the auxiliary heat exchanger is disposed forward of the front heat exchanger, and includes a portion disposed rearward of the rear heat exchanger.

9. The air conditioner according to claim 2, wherein a refrigerant temperature detecting unit configured to detect a temperature of the refrigerant is provided at a position between the liquid inlet and an outlet of the auxiliary heat exchanger.

10. The air conditioner according to claim 9, wherein:

the main heat exchanger includes a front heat exchanger disposed on a front side in an indoor unit, and a rear heat exchanger disposed on a rear side in the indoor unit; and the auxiliary heat exchanger is disposed forward of the front heat exchanger.

11. The air conditioner according to claim 10, wherein the auxiliary heat exchanger is disposed forward of the front heat exchanger, and includes a portion disposed rearward of the rear heat exchanger.

12. The air conditioner according to claim 2, wherein:

the main heat exchanger includes a front heat exchanger disposed on a front side in an indoor unit, and a rear heat exchanger disposed on a rear side in the indoor unit; and the auxiliary heat exchanger is disposed forward of the front heat exchanger.

13. The air conditioner according to claim 12, wherein the auxiliary heat exchanger is disposed forward of the front heat exchanger, and includes a portion disposed rearward of the rear heat exchanger.

14. The air conditioner according to claim 1, wherein a refrigerant temperature detecting unit configured to detect a temperature of the refrigerant is provided at a position between a liquid inlet and an outlet of the auxiliary heat exchanger.

15. The air conditioner according to claim 14, wherein:

the main heat exchanger includes a front heat exchanger disposed on a front side in an indoor unit, and a rear heat exchanger disposed on a rear side in the indoor unit; and the auxiliary heat exchanger is disposed forward of the front heat exchanger.

16. The air conditioner according to claim 15, wherein the auxiliary heat exchanger is disposed forward of the front heat exchanger, and includes a portion disposed rearward of the rear heat exchanger.

17. The air conditioner according to claim 1, wherein:

the main heat exchanger includes a front heat exchanger disposed on a front side in an indoor unit, and a rear heat exchanger disposed on a rear side in the indoor unit; and the auxiliary heat exchanger is disposed forward of the front heat exchanger.

18. The air conditioner according to claim 17, wherein the auxiliary heat exchanger is disposed forward of the front heat exchanger, and includes a portion disposed rearward of the rear heat exchanger.

* * * * *